US005411146A

United States Patent [19]

Jarecki et al.

[11] Patent Number: 5,411,146

[45] Date of Patent: May 2, 1995

[54] SHELVING DISPLAY AND STORAGE SYSTEM FOR BULK CONTAINER ITEMS

[75] Inventors: James J. Jarecki, Greendale; Paul Mylander, New Berlin; James L. Wiest, Milwaukee, all of Wis.

[73] Assignee: Newell Operating Company, Freeport, Ill.

[21] Appl. No.: 896,027

[22] Filed: Jun. 9, 1992

[51] Int. Cl.[6] ..... A47B 55/00; A47B 57/58

[52] U.S. Cl. ..... 211/59.2; 211/184; 312/128

[58] Field of Search ..... 211/49.1, 59.2, 184, 211/59.3; 312/114, 128, 35

[56] References Cited

U.S. PATENT DOCUMENTS 1,702,987 2/1929 Wilson ..... 211/59.3 X
2,098,844 11/1937 Waxgiser .
2,934,212 4/1960 Jacobson .
3,858,717 1/1975 Peters .
4,136,783 1/1979 Karashima .
4,560,073 12/1985 King ..... 211/184
4,562,928 1/1986 Erickson ..... 211/49.1 X
4,813,535 3/1989 Radocha et al. .
4,899,893 2/1990 Robertson .
4,944,390 7/1990 Baucom et al. .
5,048,699 9/1991 Trevaskis .

*Primary Examiner*—Joseph M. Gorski
*Attorney, Agent, or Firm*—Baker & McKenzie

[57] ABSTRACT

An improved shelving display system is provided for bulk containers, cases or boxes of merchandise. The goods may be displayed in the boxes or cases and the angle of display may be varied accordingly. Further, the shelf display system is fully adjustable for different sizes of boxes or cases of goods. The display system is intended to be installed directly over a existing warehouse-type shelf or smaller embodiments are available for mounting on a pegboard-type display.

9 Claims, 4 Drawing Sheets

SHELVING DISPLAY AND STORAGE SYSTEM FOR BULK CONTAINER ITEMS

This invention relates generally to merchandise display systems for warehouse merchandising and, specifically to display systems designed for the display of bulk containers, cases or boxes of goods. More particularly, this invention relates to an improved shelf display system for use in warehouse merchandising that enables the retailer to display boxes of goods at various angles of display and further to store boxes of goods toward the rear of the shelf behind the front box on display and the ability to retrieve the stored boxes.

BACKGROUND OF THE INVENTION

As the warehouse style of retailing increases in popularity, warehouse retailers are continually looking for ways to improve product presentation while not adversely affecting the economics of warehouse retailing. For example in relation to the present invention, warehouse retailers display many products in bulk containers, boxes or cases because such a display system is economical. The products do not need to be unpacked and peg hooked or arranged on a shelf thereby saving time and labor costs. The display of many smaller products in boxes is an effective and inexpensive method of product display.

However, once the box of goods is opened and placed on display, the box may become shifted and otherwise put in a state of disarray thereby presenting a untidy and disorganized look that is lacking in aesthetic appearance and consumer appeal. On the other hand, if the warehouse retailer went to the effort of removing the goods from the boxes and organizing them on a shelf or other display system, the operating costs of the warehouse retail operation would increase and the economics would be adversely affected.

Thus, there is a need for an improved method of displaying goods still contained in their bulk containers, cases or shipping boxes. The warehouse retailer must display certain goods in boxes in order to keep costs down and compete with other warehouse retailers. However, in an effort to attract consumers away from traditional retail outlets, the successful warehouse retailer will not only have to offer low prices but will desirably offer products that are attractively displayed and visually appealing to consumers.

The present invention makes a significant contribution to this effort. Specifically, the present invention allows the warehouse retailer to store goods still contained in boxes behind the front box on display. Further, the present invention allows the warehouse retailer to display the box at various angles for an improved presentation. Specifically, some products, such as paint rollers are effectively displayed when the box is tilted forward toward the consumer while other products, such as paint brushes, are better displayed when the box is tilted rearward away from the consumer.

The present invention allows the warehouse retailer to employ one shelving system that is adjustable with respect to the angle of display of the box and that will accommodate a wide variety of box sizes. Further, the present invention allows the warehouse retailer to store extra boxes of goods behind the front box of goods on display and further provides an easy retrieval system for the boxes of goods stored behind the front box and toward the rear of the shelf.

As will be shown below, the present invention also provides an improved shelving display system for bulk containers of goods that can be mounted in a pegboard-type of display system. Pegboard-type displays are extremely useful for displaying goods but are labor intensive to load each individual product manually. The present invention overcomes this problem.

BRIEF DESCRIPTION OF THE INVENTION

The present invention makes a significant contribution to the warehouse retailing industry by allowing the warehouse retailer to display boxes of goods at various angles of display. The present invention allows the warehouse retailer to choose the appropriate display angle for each product displayed. Further, because the present invention is fully adjustable for different sizes of boxes and different angles of display, the present invention enables the warehouse retailer to employ one shelving display system for a wide variety of goods.

The shelf-mounted embodiment of the improved shelf display system includes a base that rests on top of an existing shelf. The base includes a series of transversely extending crosspieces mounted on two or more longitudinally extending rods.

The longitudinally extending rods of the base terminate in an inverted U-shaped front end that is attached to an upwardly protruding front section. A front panel mounted on top of the front section provides an ideal place for displaying indicia such as product names, sizes and other product information. The front section provides support for a front portion of a box.

Back supports are provided by one or more A-shaped support members that mount on any two adjacent transversely extending crosspieces. The A-shaped supports provide support for a rear portion of a box. The support members are easily detached and move forward or rearward thereby enabling the shelf to be adjusted for both the angle of display and the size of the box to be displayed.

It will be noted that most shelf systems in warehouse retail operations are quite large thereby providing extra storage space behind the front box on display. The present invention enables easy access to boxes of goods stored behind the front box of goods via a rear box puller mechanism. The rear box puller consists of an elongated wire frame featuring a front handle, two longitudinally extending rods disposed on either side of an A-shaped support member on top of the base and an upwardly protruding rear end. The upwardly protruding rear end is used for engaging or grasping boxes of goods stored towards the rear of the shelf. When the container on display is empty, the empty box is quickly removed and the clerk pulls the front handle of the rear box puller forward. The rear end of the rear box puller engages a box stored towards the rear of the shelf and the stored box is pulled forward for easy access by the store clerk. The shelf is restocked simply by cutting open the just-retrieved box, placing it on display and returning the rear box puller to its original position.

The display system supports the box at three points. If the box to be displayed is to be tilted forward and downward, a rear portion of the bottom panel of the box rests on top of the A-shaped support member. The bottom/front corner of the box will rest against the longitudinally extending rods of the rear box puller frame or the base and the front panel of the box will rest against the front section of the display system. On the other hand, if the box is to be tilted rearward when on display, the rear panel will rest against the A-shaped support member. The rear/bottom corner of the box will rest against the longitudinally extending rods of the rear box puller or the base and a front portion of the bottom panel of the box will rest against the front section of the display system. The angles of display may be altered by simply moving the A-shaped support member forward or rearward.

Smaller versions of the present invention are also appropriate for peg-board/peg-hook types of displays. These types of displays are especially effective for displaying goods above conventional shelves at higher elevations. As noted above, pegboard-type displays are generally labor intensive because each individual product must be manually loaded onto a outwardly protruding display rack. The present invention overcomes this problem by providing a shelving system for pegboard displays that enables the goods to be effectively displayed in cases or boxes instead of being manually loaded onto racks. The rear end of the base is suspended from a hanging mechanism which is attached to the vertical wall pegboard.

It is therefore an object of the present invention to provide an improved adjustable shelving system for displaying bulk containers, cases or boxes of goods in warehouse retail stores.

It is another object of the present invention to provide an improved adjustable shelving system for the display of boxes of goods whereby boxes of goods stored toward the rear of the shelf may be easily retrieved thereby facilitating the restocking of the shelf.

It is yet another object of the present invention to provide an improved adjustable display system for boxes of goods that may be mounted on a pegboard-/peg-hook type display system.

It is yet another object of the present invention to provide an improved display system for boxes of goods that may be used with existing store shelves without costly modification or requiring an excessive amounts of labor to stock or restock the goods.

BRIEF DESCRIPTION OF THE DRAWINGS

This invention is illustrated more or less diagrammatically in the accompanying drawings, wherein.

DETAILED DESCRIPTION OF THE INVENTION

Figure 1:
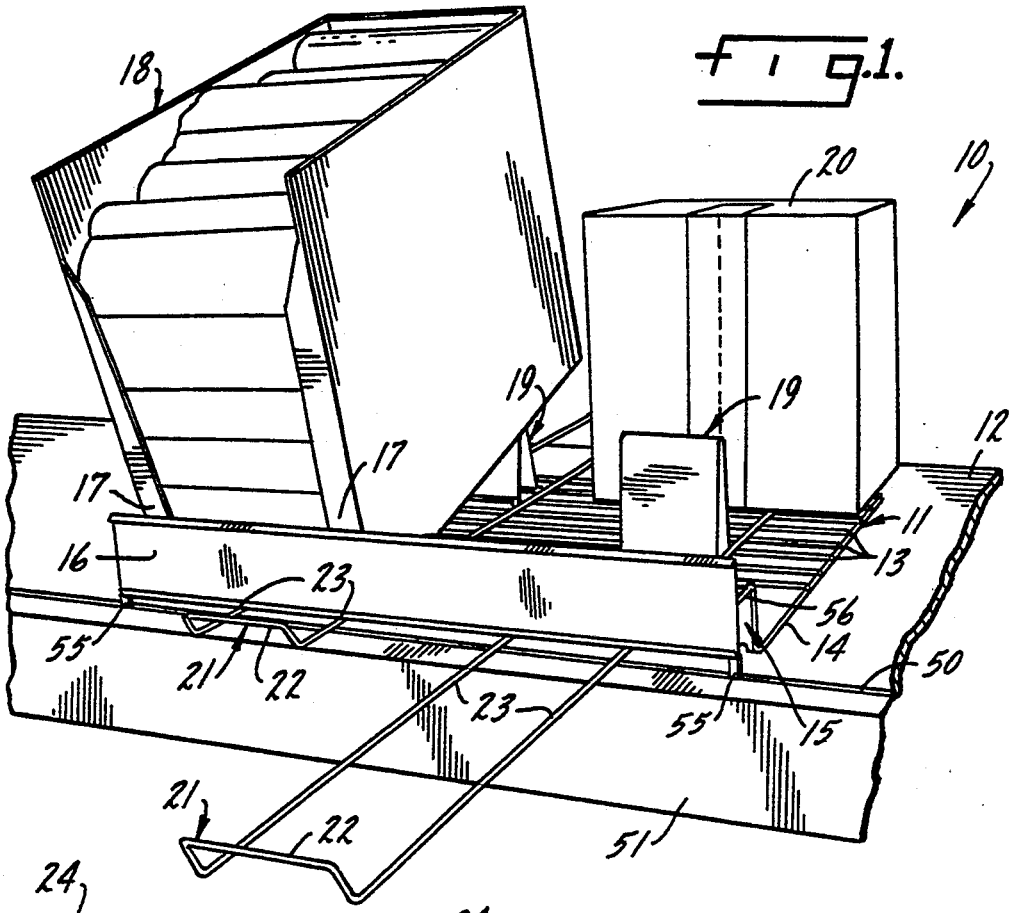
FIG. 1 is a right front perspective view of a section of a shelf display system made in accordance with the present invention and further illustrating one box of goods on display tilted downward towards the consumer and another unopened box of goods stored behind an A-shaped support member on an adjacent shelf section.

Like reference numerals will be used to refer to like or similar parts from Figure to Figure in the following description of the drawings.

The dramatic improvement contributed by this invention is best understood after consideration of the present methods of displaying boxes of goods in warehouse retail stores. The boxes are opened and displayed on large, flat shelves. As consumers examine the goods, the boxes may be shifted from their original position. Eventually, the entire aisle of goods takes on a disorderly appearance. Further, when a supply of goods displayed in a large box becomes depleted, the consumer often is forced to reach deep into a large box in order to obtain the desired product. Finally, when a store clerk is attempting to restock a particular product, the boxes of goods stored toward the rear of the shelf are often out of reach.

Figure 2:
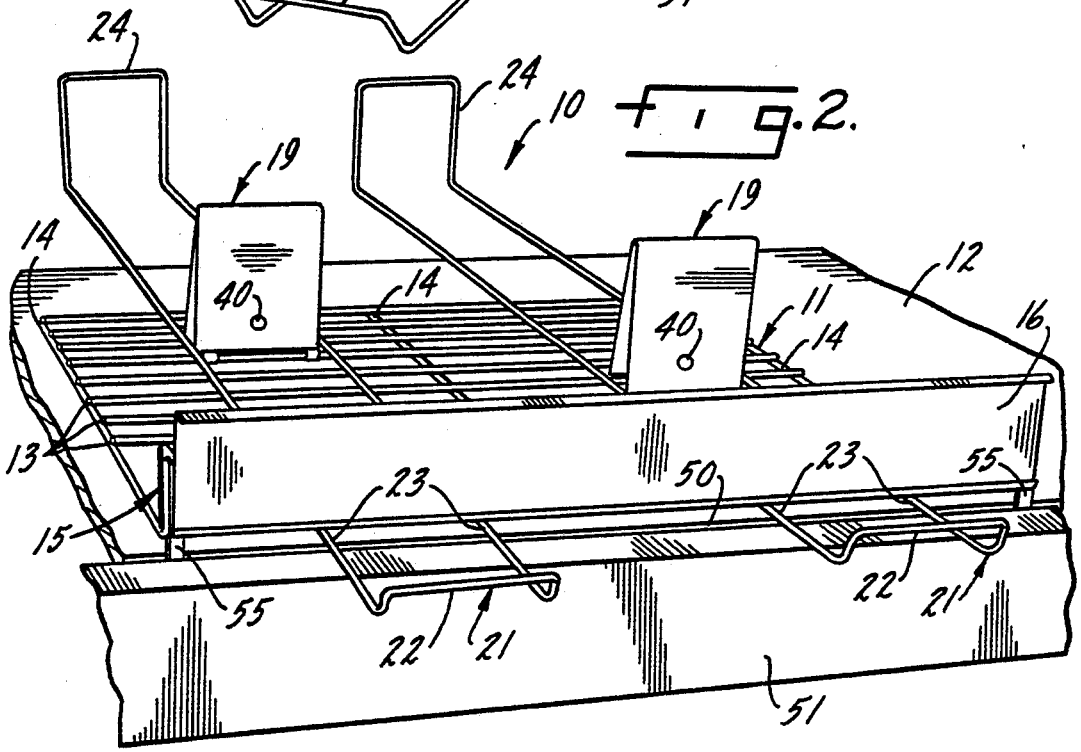
FIG. 2 is a left front perspective view of the shelf display system shown in FIG. 1 without any boxes.

The present invention solves the aforenoted problems as follows. Referring to FIGS. 1 and 2 simultaneously, the shelf display system 10 includes a base 11 which rests upon a standard warehouse store shelf 12. The base 11 consists of a series of transversely extending crosspieces 13 which are mounted on longitudinally extending support rods 14.

The front section, shown generally at 15, of the shelf display system 10, is connected to at the front end of the longitudinally extending rods 14. The front ends of the longitudinally extending rods 14 terminate in inverted U-shape fronts 56 (see also FIG. 5) which themselves terminate in a downwardly protruding legs 55. The downwardly protruding legs 55 are engaged in a clearance 50 in the front of the shelf 12 and act to keep the shelf 12 in position. The legs 55 can be easily removed for systems without the clearance 50. The front section 15, see also FIG. 5, further includes a display panel 16 which is especially appropriate for the display of indicia such as trademarks, product information and the like.

The front section 15 also restrains and supports the lower front portion 17 of the box 18 which is seen on display in FIG. 1. On the other hand, the rear portion of the bottom panel (not shown) of the box 18 is restrained and supported by an A-shaped support 19 (only partially shown in FIG. 1).

Figure 4:
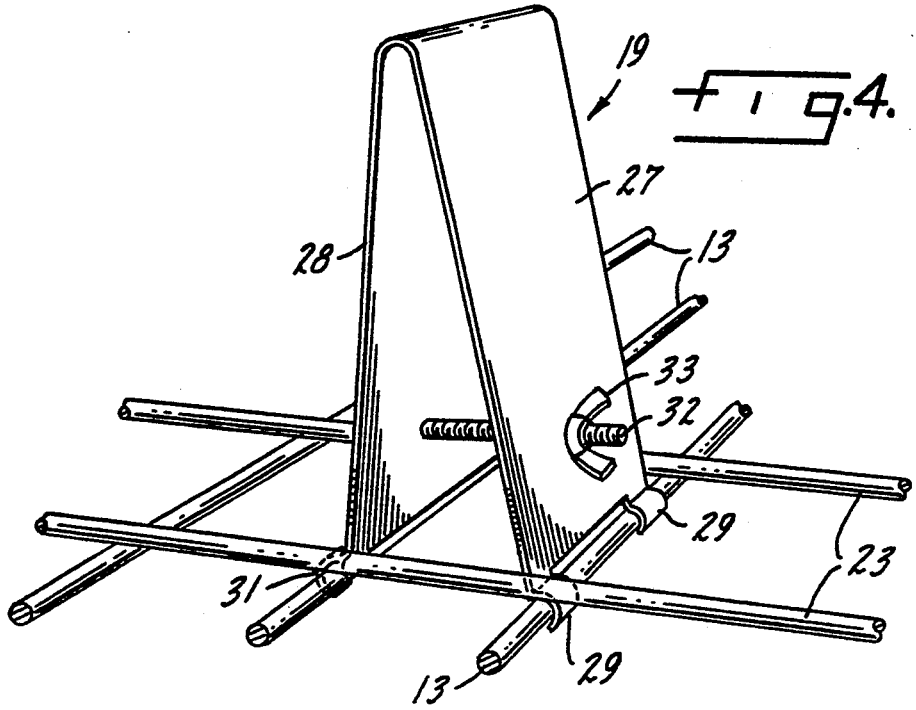
FIG. 4 is a rear perspective view of an A-shaped support member of the shelf display system shown in FIG. 1.

FIGS. 1, 2 and 4 also show the operation of the rear box pullers, or rear container pullers, shown generally at 21. As seen in FIG. 2, a rear box puller 21 includes a front handle 22, two longitudinally extending rods 23 disposed on either side and adjacent to, but not connected to, an A-shaped support member 19, and an upwardly protruding rear end portion 24 which engages the boxes of goods stored behind the box of goods on display. For example, when a store clerk pulls the handle 22 of the rear box puller 21 shown at the right in FIG. 1, the box of goods 20 is engaged by rear end portion 24 (not shown in FIG. 1) and the clerk is able to move the right box 20 forward for restocking.

It is also to be noted, in FIGS. 1 and 2, the A-shaped support members 19 are not fixedly attached to the crosspieces 13. Rather, as best seen in FIGS. 3 and 4, the A-shaped support members may be moved and reattached to any two adjacent crosspieces 13 in order to adjust the angle of display of a box such as 25 or 26 or for different sizes of boxes such as 25, 26.

Figure 3:
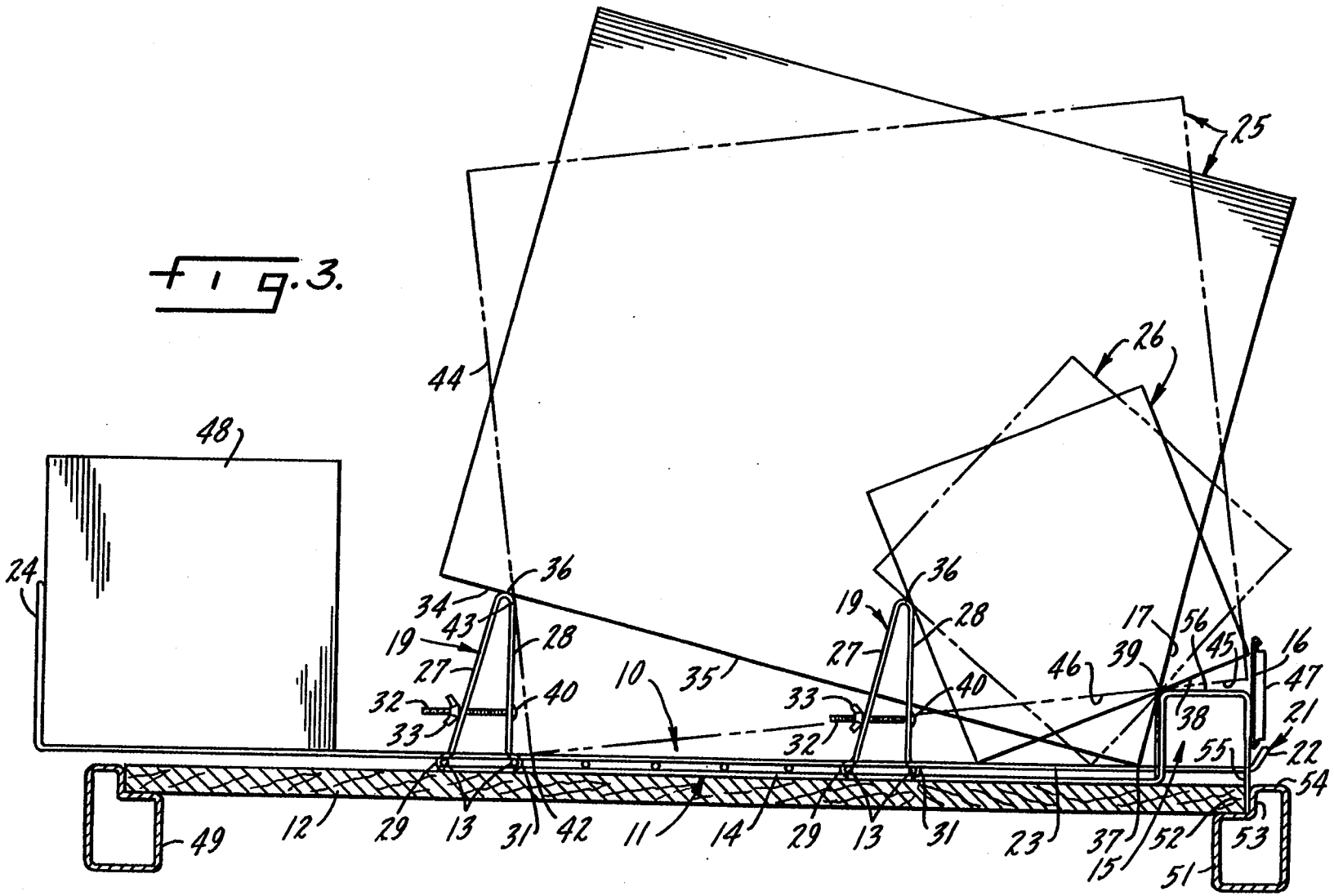
FIG. 3 is a left side view of the shelf display system shown in FIG. 1 particularly illustrating two sizes of boxes and various angles of display.

As seen in FIG. 3, the shelf display system 10 is fully adjustable as to both the angle of display of the boxes 25, 26 and the size of the boxes 25, 26. For the larger box 25, the A-shaped support 19 should be moved rearward as shown. For the smaller box 26, the A-shaped support member 19 should be moved forward. It is to be noted that each A-shaped support member is easily attached and reattached to the crosspieces 13. Each A-shaped support member includes two legs 27, 28. The lowermost end of each leg 27, 28 includes a pair of hooks 29, 31. The hooks 29, 31 engage a crosspiece 13 and are positively held in place by the adjustment of bolt 32 with a head 40 and a wing nut 33.

Referring to the box indicated at 25, the display system 10 allows the retailer to position the box 25 in a downwardly slanted position (solid lines) or an upwardly slanted position (dashed lines). In order to present the box 25 in a downwardly slanted position (see the solid lines), the rearward end 34 of the bottom panel 35 of the box 25 rests against the top edge 36 of the A-shaped support 19. The lower front corner 37 of the box 25 is supported by the base 11. The lower front portion 38 of the box 25 rests against the upper end 39 of the front wall 41 (see FIG. 5). The lower end 59 of the front wall 41 also includes a series of notches 57 that engage the longitudinally extending rods 23 of the rear box pullers 21.

In order to tilt a box, such as 25, in an upwardly slanted fashion (see the dashed lines), the box 25 is positioned so that the lower rear corner 42 rests against the base 11. A lower rear portion 43 of the rear panel 44 rests against the top 36 of the A-shaped support 19. The front portion 45 of the bottom panel 46 rests against the top 39 of the front wall 41 (see FIGS. 3 and 5).

FIG. 3 also illustrates the use of the front panel 16 as a panel for displaying indicia 47 such as trademarks, product information and the like.

Storage space for unopened boxes, such as box 48, is provided behind the A-shaped support members 19. The upwardly protruding rear end 24 of the rear box puller 21 engages the box 48 so that it may be pulled forward.

The shelf display system 10 rests upon a standard warehouse-type shelf 12 which is supported by standard crossbeams 49 and 51. Referring to the front crossbeam 51, a clearance 50 (not shown in FIG. 3; see FIGS. 1 and 2) is provided between the front end 52 of the shelf 12 and the rear wall 53 of the upward projection 54 of the crossbeam 51. The clearance 50 accommodates the downwardly protruding legs 55 which are the terminal extensions of the longitudinally extending support rods 14 (see FIG. 5). The engagement of the downwardly protruding legs 55 in the clearance 50 prevents any displacement of the shelf display 10 by consumers or by the store clerk when employing the rear box puller.

Turning now to FIG. 4, a detailed view of the A-shaped support member 19 is provided. The rear leg 27 extends downward and terminates in a pair of rear hooks shown at 29 which wrap partially around a crosspiece 13. The front leg 28 extends downward and terminates in two hooks 31 (only one of which is shown in FIG. 4). The hooks 29 and 31 positively engage the crosspieces 13 upon tightening of the wing nut 33 on the adjustment bolt 32. The A-shaped support member 19 may be easily removed from the crosspieces by simply loosening the wing nut 33 and spreading the legs 27, 28 with manual pressure. The A-shaped support member 19 may be attached to any two adjacent crosspieces 13, 13. Each A-shaped support 19 is disposed in between two longitudinally extending rods 23 of a rear box puller 21.

Figure 5:
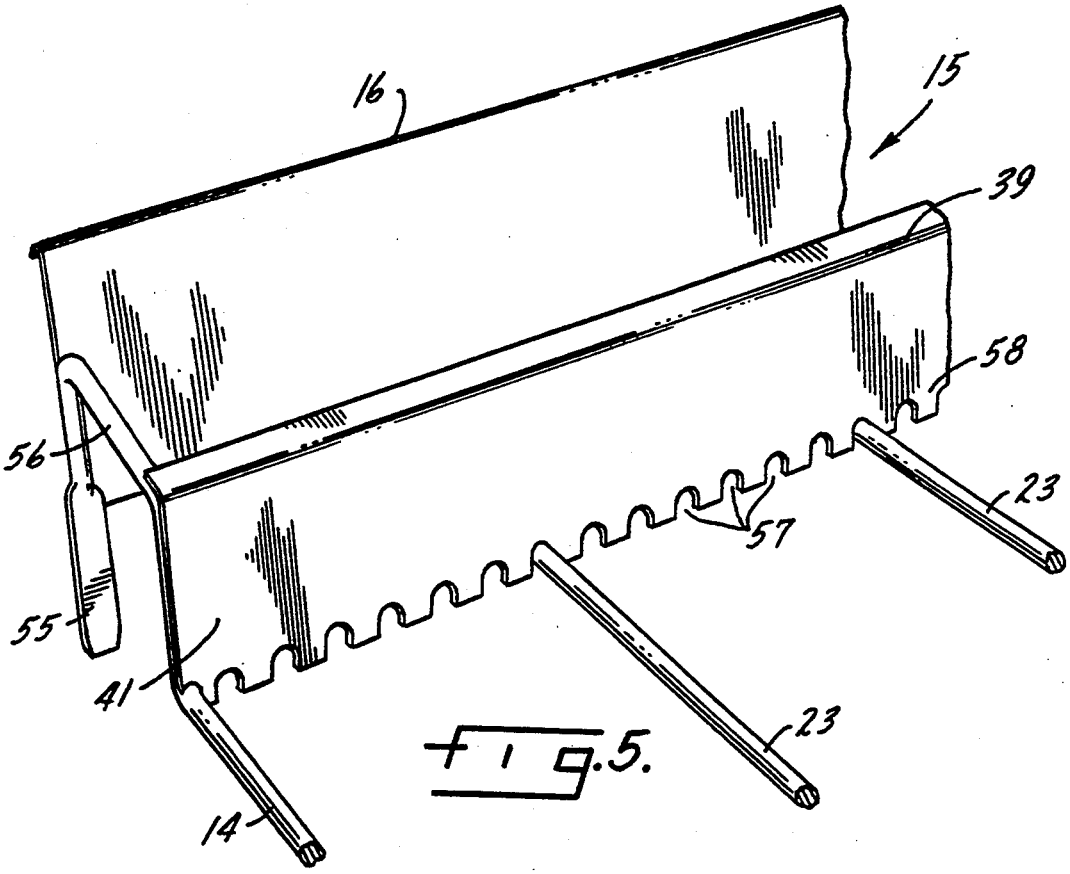
FIG. 5 is a rear partial perspective view of the front section of the shelf display system shown in FIG. 1.

A rear view of the front section 15 is shown in FIG. 5. The longitudinally extending support rod 14 terminates in an inverted U-shaped front portion 56 which terminates in the downwardly protruding leg 55 which is accommodated by the slot 50 (see FIGS. 1 and 2) disposed in between the end 52 of the shelf 12 and the rear wall 53 of the upward protrusion 54 of the front crossbeam 51 (see FIG. 3). Two longitudinally extending rods 23 of a rear box puller 21 are also shown in FIG. 5. As can be appreciated from FIGS. 4 and 5 when considered together, the longitudinally extending rods 23 are disposed closely adjacent to the sides of the A-shaped support members 19. Thus, the A-shaped support members 19 serve as guides to the forward and rearward movement of the rods 23. Additional guidance and stability is provided by the notches 57 provided in the lower end 59 of the front wall 41.

Figure 6:
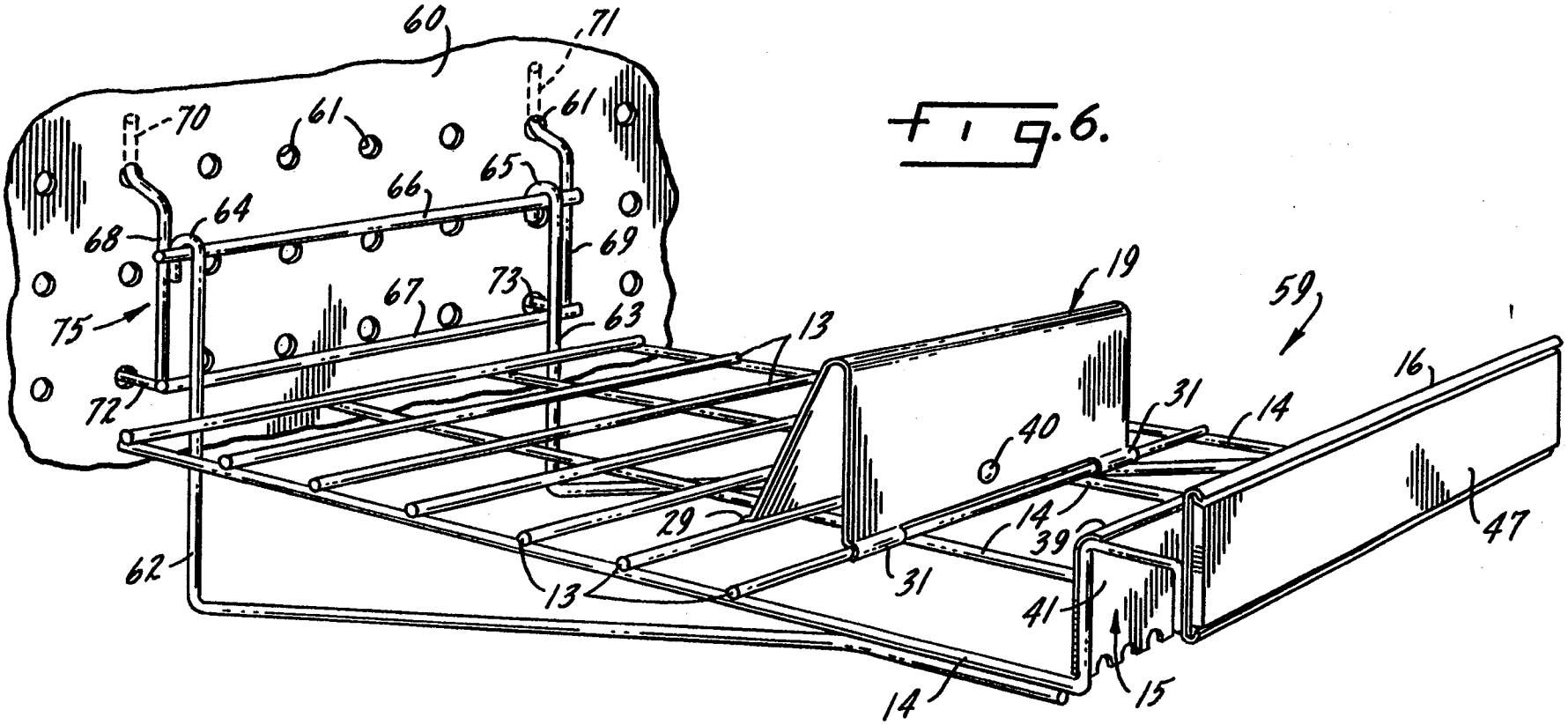
FIG. 6 is a left front perspective view of an alternative embodiment of the present invention specifically designed for pegboard-type displays.

Turning to FIG. 6, an alternative embodiment of shelf display system, indicated generally at 59, attaches to a vertical pegboard 60 with holes 61. As in the embodiment discussed above, the base 11 is formed from support rods 14 and crosspieces 13. An A-shaped support 19 engages the a rear portion of a box and the top 39 of the front wall 41 supports a front portion of a box (not shown). The hooks 29, 31 of the A-shaped support 19 each engage a crosspiece 13 and are positively held in place by the adjustment bolt (not shown) with a head 40. The front section, shown generally at 15, also includes a front display panel 16 for the display of indicia 47 such as trademarks and other product information.

The shelf system 59 is supported by two L-shaped arms 62, 63. Two hooks 64, 65 at the upper ends of the L-shaped arms 62, 63 engage the upper horizontal crosspiece 66 of the hanger mechanism, shown generally at 73. Both horizontal crosspieces 66, 67 are attached to vertical rods 68, 69. The upper ends of the vertical rods 68, 69 include hooks 70, 71 which positively engage two separate holes 61 in the vertical wall 60. The legs 72, 73 also engage two holes 61 but are intended more for guidance than for actual support. As weight is placed on the front end of the shelf 59, the cantilever force exerted on the hooks 70, 71 is offset by an equal force of the two L-shaped arms 62, 63 against the lower horizontal crosspiece 67. A rear box puller, such one shown at 21 in FIGS. 1–3, may be included for larger sturdier shelf systems designed for vertical pegboards 60.

Thus, a fully adjustable display system for bulk containers or cases of goods is provided. The display system may be adjusted for varying angles of display and various sizes of boxes. The display system provides storage for unopened boxes of goods behind the front box on display. The display system is simply and easily installed right on top of existing warehouse-type store shelves. Little or no modification of existing shelves is required.

Although only two preferred embodiments of the present invention have been illustrated and described, it will at once be apparent to those skilled in the art that variations may be made within the spirit and scope of the invention. Accordingly, it is intended that the scope of the invention be limited solely by the scope of the hereafter appended claims and not by the specific wording in the foregoing description.

We claim:

1. A system for displaying goods in bulk containers on a shelf, the system comprising:

a base including a front end, two opposing sides a rear section and a plurality of generally parallel crosspieces extending between the two opposing sides, the front end being connected to a front wall for restraining and supporting containers, the front wall extending generally upwardly above the the base, back support which extends upwardly from the base, the back support being detachably attached to two parallel crosspieces so that the back support may be positioned at varying distances from the front wall, at least one rear container puller retrieving bulk containers stored behind the back support, the rear container puller comprising a rear end, a front end and two parallel rods connecting the front and rear ends, the back support being accommodated between the parallel rods and providing a guide for forward and rearward movement of the rear container puller, the rear end of the rear container puller including an upwardly projecting portion for engaging containers stored on top of the rear container puller behind the back support, the front end of the rear container puller extending below the front wall and above the shelf, the front end of the rear container puller further including a handle for pulling the rear container puller forward to retrieve bulk containers stored on top of the rear container puller behind the back support, whereby, depending on the size of a bulk container and the distance between the front wall and the back support, a bulk container is restrained by the front wall the back support and supported by the front wall and the back support against normal dislodgement forces in either a tilted forward or a tilted rearward position and bulk containers stored behind the back support on top of the rear container puller may retrieved and pulled forward along a path defined by engagement between the rods of the rear container puller and the back support disposed therebetween.

2. The system of claim 1, wherein the back support comprises an A-shaped member with two legs, each leg detachably attached to a crosspiece of base.

3. The system of claim 1, wherein the front wall further includes a means for displaying indicia.

4. The system of claim 1, wherein the base is supported by the shelf, the shelf having a front edge, the front edge of the shelf having a clearance, and the front end of the base including at least two downwardly protruding legs, the downwardly protruding legs being accommodated in the clearance disposed in the front edge of the shelf, whereby the downwardly protruding legs inhibit frontward and rearward movement of the system.

5. A system for displaying goods in bulk containers on shelves, the system enabling retailers to display bulk containers at various angles of display, the system comprising:

a base, a front section, a back support, at least one rear container puller, the base including a front end and a rear end, the base providing a means for horizontal support of a lowermost portion of at least one bulk container;

the front section extending substantially vertically upward from the front end of the base, the front section providing support for a front portion of at least one bulk container;

the back support being attached to the base in between the front end and the rear end of the base, the back support extending generally substantially vertically upward, the back support supporting a rear portion of at least one bulk container and guiding the forward and rearward movement of a rear container puller;

the rear container puller comprising a rear end and a front end and two opposing parallel rods connecting the front and rear ends, the back support being disposed between the rods, the rear end including an upwardly projecting element for engaging containers stored on top of the rear container puller behind the back support, the front end of the rear container puller extending below the front section, the front end further including a handle for pulling the rear container puller forward to retrieve bulk containers stored on top of the rear container puller behind the back support.

6. The system of claim 5, wherein the back support is detachably attached to the base and the position of the back support between the front end and the rear end of the base may be changed, thereby functioning to alter to alter the angle of display of the bulk container.

7. The system of claim 6, wherein the front section further includes a means for displaying indicia.

8. The system of claim 7, wherein the base is supported by a shelf, the shelf having a front edge, the front edge of the shelf having a clearance, and the front end of the base including at least two downwardly protruding legs, the downwardly protruding legs being accommodated in the clearance disposed in the front edge of the shelf, whereby the downwardly protruding legs inhibit frontward and rearward movement of the system.

9. A system for the display of bulk containers of goods, the system comprising:

a base, a shelf, a front section, at least one back support, a rear container puller, the base including a front end and a rear end, at least two longitudinally extending support rods connected to a plurality of longitudinally spaced crosspieces, the crosspieces functioning to attach the back support to the base, the base providing horizontal support for a lowermost portion of at least one bulk container;

the base being supported by the shelf, the shelf having a front edge, the front edge of the shelf having a clearance;

the front section being attached to the front end of the base, the front end of the base including at least two downwardly protruding legs, the downwardly protruding legs being accommodated in the clearance disposed in the front edge of the shelf, the engagement of the legs in the clearance inhibiting longitudinal movement of the system, the front section supporting a front portion of at least one bulk container;

the back support including an A-shaped member with two legs, each leg being detachably attached to a different crosspiece of the base and in between the front end and the rear end of the base, the back support supporting a rear portion of at least one bulk container;

the rear container puller including a rear end and a front end and two opposing parallel rods connecting the front and rear ends, the back support being disposed between the two rods and serving as a guide for forward and rearward movement of the rear container puller, the rear end including an upwardly projecting back member for engaging containers stored on top of the rear container puller and behind the back support, the front end of the rear container puller extending below the front section, the front end of the rear container puller further including a handle means for pulling the rear container puller forward to retrieve bulk containers stored on top of the rear container puller and behind the back support;

whereby, at least one bulk container may be displayed at an angle, the front portion of the bulk container being supported by the front section, the rear portion of the bulk container being supported by the back support and the lowermost portion of the bulk container being supported by the base and the rear container puller facilitating the retrieval of containers stored behind the back support and the restocking of the display shelf system.

* * * * *